US005947202A

United States Patent [19]

Gazewood

[11] Patent Number: 5,947,202

[45] Date of Patent: Sep. 7, 1999

[54] METHOD AND APPARATUS FOR ENGAGING AN OBJECT

[75] Inventor: Michael J. Gazewood, Scott, La.

[73] Assignee: Thru-Tubing Technology, Inc., Scott, La.

[21] Appl. No.: 08/910,372

[22] Filed: Aug. 13, 1997

[51] Int. Cl.[6] ..... E21B 31/00

[52] U.S. Cl. ..... 166/301; 294/86.24; 166/98

[58] Field of Search ..... 294/86.23, 86.24, 294/86.25; 166/301, 98, 178

[56] References Cited

U.S. PATENT DOCUMENTS

| | | | |
|---|---|---|---|
| 1,728,136 | 9/1929 | Power . | |
| 1,794,652 | 3/1931 | Stone . | |
| 1,815,462 | 7/1931 | Denney . | |
| 1,823,340 | 9/1931 | Vance . | |
| 1,917,135 | 7/1933 | Littell . | |
| 2,732,901 | 1/1956 | Davis | 166/98 |
| 2,806,534 | 9/1957 | Potts | 166/98 |
| 3,199,906 | 8/1965 | Chenoweth | 294/86.15 |
| 3,262,501 | 7/1966 | Winger | 166/131 |
| 3,638,989 | 2/1972 | Sandquist | 294/86.24 |
| 4,273,372 | 6/1981 | Sheshtawy | 294/86.15 |
| 5,145,228 | 9/1992 | Boyle | 294/86.25 |
| 5,242,201 | 9/1993 | Beeman | 294/86.17 |
| 5,775,433 | 7/1998 | Hammett et al. | 166/98 |

*Primary Examiner*—William Neuder

*Attorney, Agent, or Firm*—Domingue, Delaune & Waddell, PLC

[57] ABSTRACT

A device for latching onto a down hole object located within a well bore is claimed. The device will include a mandrel connected to a work string and with an end adapted to engage the object. The device also includes a biasing member disposed about the mandrel; and, a collet member operatively disposed about the mandrel. The collet member will have a first end adapted to cooperate with the biasing member and a second end that contains an engaging member, operatively associated with the second end of the mandrel, for engaging the object. The mandrel and the collet member cooperate to form a chamber. The device will also include a locking member, contained within the chamber, for locking the mandrel and collet member together so that the mandrel and collet member act as one member. The locking member includes: a detent member; a housing member containing the detent member; a piston, adapted for containment within the chamber, for activating the locking member; and, a groove on the mandrel that cooperates with the detent member. The device may further comprise an activation port, associated with the mandrel, for activating the piston so that the housing member holds the detent member within the groove. The work string may be attached to a drill string, coiled tubing string or other work string. The object may be a stuck down hole tool, a down hole packer means, or some other type of apparatus used in the drilling, completion, and/or production of wells. Also disclosed is a method of engaging a down hole object with the spear device.

20 Claims, 14 Drawing Sheets

SECTION "A-A"

SECTION "B-B"

METHOD AND APPARATUS FOR ENGAGING AN OBJECT

BACKGROUND OF THE INVENTION

The invention relates to a method and apparatus for engaging an object within a well bore. More particularly, but not by way of limitation, the invention relates to a method and apparatus for mechanically latching unto an object, and thereafter, selectively locking and unlocking the apparatus for manipulation by the operator.

In the development of oil and gas fields, well bores are drilled through subterranean reservoirs. Ultimately, a well will be completed to a hydrocarbon bearing reservoir, as will be understood by those of ordinary skill in the art. Afterwards, the hydrocarbon bearing reservoir is produced, and the hydrocarbons are ultimately refined.

The well bores are generally of small diameter and many times are highly deviated. The forces necessary to drill these well bores are significant. Many times, tools become lodged within the well bore due to operational problems associated with drilling and completing wells, particularly in highly deviated, extended reach wells.

In order to retrieve these tools (sometimes referred to by those of ordinary skill in the art as a "fish"), a work string is employed that has attached thereto a retrieving tool. Once the retrieving tool is latched onto the fish, the operator will begin operations to dislodge the tool. The operation may include jarring of the fish in order to dislodge. The procedure may also include pumping of a fluid through the inner diameter of the work string and the inner diameter of the retrieving in the tool in order to aid in the retrieval of the fish. Reverse circulation about the down hole tools is also possible.

During the procedure, the operator may find it desirable and/or necessary to unlatch the retrieving tool from the fish. Also, the operator may wish to continuously pump through the retrieving tool. As those of ordinary skill in the art will appreciate, the retrieval process requires adaptation to many different circumstances. While there have been developed over the years various down hole tools for latching and retrieving down hole tools, they all suffer from several deficiencies. For instance, the prior art retrieving tools suffer from the inability to remain latched during pumping operations due to the sensitivity of the releasing mechanism to fluid pumping. Also, the prior art designs suffer from being structurally infirm. Moreover, the prior art designs can not be latched, and unlatched, multiple times with a significant degree of confidence.

Therefore, there is a need for a method and apparatus that will allow for the dependable latching and unlatching of a down hole retrieving apparatus. There is also a need for a retrieving tool that is designed for pump through application without the possibility of premature release. Further, there is a need for a retrieving tool wherein the latching and unlatching is dependable.

SUMMARY OF THE INVENTION

A device for latching onto a down hole object located within a well bore is disclosed. The device will include a mandrel having a first end connected to a work string and having a second end adapted to engage the object. The device also includes a biasing member disposed about the mandrel; and, a collet member operatively disposed about the mandrel. The collet member will have a first end adapted to cooperate with the biasing member and a second end that contains an engaging means, operatively associated with the second end of the mandrel, for engaging the object. In the preferred embodiment, the mandrel and the collet member cooperate to form a chamber.

The device will also include a locking means, contained within the chamber, for locking the mandrel and collet member together so that the mandrel and collet member act as one member. In the preferred embodiment, the biasing member comprises a spring member adapted to urge the collet member into engagement with the collet engaging means. The locking means may comprise: a detent member; a housing member containing the detent member; a piston means, adapted for containment within the chamber, for activating the locking means; and, a groove on the mandrel that cooperates with the detent member.

The device may further comprise an activation means, associated with the mandrel, for activating the piston so that the housing member holds the detent member within the groove. In one embodiment, the collet member contains a protuberance for cooperation with a fishing neck contained within the down hole object that is to be retrieved. Also, the piston means may comprise a cylindrical member disposed about the mandrel. The work string may be attached to a drill string, coiled tubing string or other work string. The object may be a stuck down hole tool, a down hole packer means, or some other type of apparatus used in the drilling, completion, and/or production of wells.

Also disclosed is a method of engaging an object within a well bore. The method includes positioning a spear device into the well bore. In the preferred embodiment, the spear device contains: a mandrel having a first end connected to a work string and having a second end with a cam surface; a biasing member disposed about the mandrel; a collet member operatively disposed about the mandrel, with the collet member having a first end adapted to cooperate with the biasing member and a second end having a protuberance adapted to engage the object, with the mandrel and the collet member forming a chamber therein; and locking means, contained within the chamber, for locking the mandrel relative to the collet member.

The method further includes lowering the spear device so that the second end of the mandrel enters the object. Next, the protuberance is contacted with the object so that the collet member remains stationary in relation to the object as the mandrel is lowered into the object which in turn will compress the biasing member. The method includes the contracting of the collet members and thereafter lowering the collet member through the fishing neck so that the protuberance is in the fishing neck. Next, the operator will pull on the work string so that the biasing means urges the protuberance into cooperation with the cam surface so that the protuberance engages with the fishing neck of the object.

The method may further include lowering the work string and allowing the mandrel to move downward relative to the collet member so that the protuberance no longer cooperates with the cam surface. The operator may then begin pumping a fluid through the inner diameter of the work string and the mandrel which in turn activates the locking means into engagement. In one embodiment, the locking means includes: a detent member; a housing member containing the detent member; a piston means, operatively associated with the chamber, for activating the locking means; and wherein the mandrel contains a groove that cooperates with the detent member. The method of activating the locking means includes engaging the piston means with the housing by applying a pressure in the chamber. Next, the housing is moved downward relative to the mandrel, and the detent member is positioned into the groove so that the mandrel is locked with the collet member.

The operator may opt to terminate the pumping of fluid and thereafter allow the detent members to fall out of the groove so that the mandrel is no longer locked with the collet member. The operator will then urge the protuberance into the cam surface, and thereafter, raise the work string. Due to the novel design, the spear device will engage with the object.

During the pumping phase, the operator may opt to continue pumping, and thereafter pull on the work string which will in turn raise and clear the protuberance from the fishing neck. The operator will continue pulling on the work string which will raise and clear the second end of the mandrel from the fishing neck. The operator may continue pulling the work string from the well bore.

An advantage of the present invention is that it is possible to circulate at high flow rates. Another advantage is that the device will not release during continuous pumping operations. Yet another advantage is the design allows for the option of multiple latching and re-latching. Another advantage is that the novel design allows for the use of bulky components such as the mandrel and collets so that the strength of the overall tool is increased significantly from prior art designs. Still yet another feature of the tool is that the presence of a well bottom is needed for the tool to get into the released position.

A feature of the present invention includes a mandrel that has an engaging end for adaptation into a down hole object. Another feature is use of a collet member that cooperates with the engaging end of the mandrel in order to engage into the object. Another feature of the present invention includes use of a means to lock the mandrel together with the collet member so that the spear device remains in place during the operation.

Another feature includes mechanically activating the latching of the mandrel and the collet member to the object. Still yet another feature includes using either a mechanical means or hydraulic means in order to lock the mandrel and collet member together. Another feature includes use of a piston and detent member as part of the locking means. Yet another feature is the mandrel and collet member may be constructed with larger outer diameters and smaller inner diameter thereby making the spear of sturdier construction.

DESCRIPTION OF THE PREFERRED EMBODIMENTS

Figure 1:
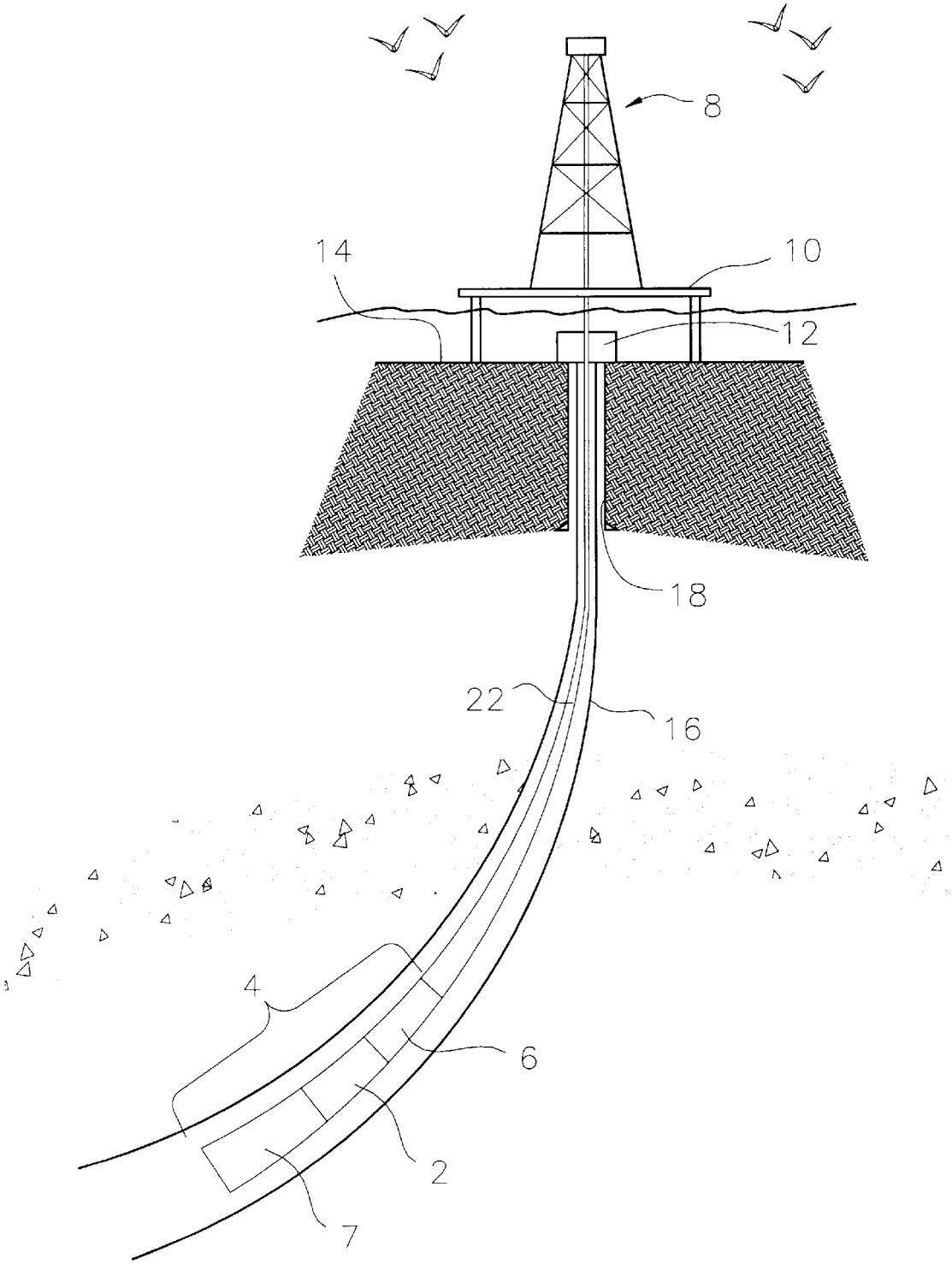
FIG. 1 depicts a drilling rig with a work string extending therefrom into a deviated well.

Referring now to FIG. 1, the spear apparatus 2 is shown as part of a bottom hole assembly 4 that includes a jar 6 for jarring an object 7 contained within the well bore. As depicted in FIG. 1, a drilling rig 8 is situated on a drilling platform 10 that may be a semi-submersible drilling rig. A sub-sea tree 12 is situated on the sea floor 14 which isolates the bore hole 16, surface casing 18 and intermediate casing (not shown) as is well understood by those of ordinary skill in the art.

A work string 22 extends from the drilling rig 8. The work string 22 may be drill pipe, coiled tubing, snubbing pipe, or production string. This list is illustrative. The work string 22 will have a bottom hole assembly 4 attached thereto that may include a jar 6 even though other types of devices are certainly possible.

As will be understood by those of ordinary skill in the art, as the angle of the bore hole 16 deviates from vertical to horizontal, the possibly of sticking down hole assemblies increases. Also, many down hole assemblies may require manipulation and/or application of force for proper operation and functioning. Thus, the highly deviated wells cause a significant problem with delivering force and/or rotation to the bottom hole assembly 4. Alternatively, if the bottom hole assembly 4 becomes lodged, transmitting force to the lodged assembly is very difficult. An advantage of the present invention is that the object 7 may be latched onto, pumped through with fluid, and unlatched multiple times (if desired) in order to accomplish the necessary task as will be more fully understood hereinafter.

The present invention is applicable to many other uses within a well such as during a completion or work over phase. Thus, the present invention allows the operator to engage an object and thereafter transmit a longitudinal force thereto. It should be noted that through out the description, like numbers in the drawings refer to like components.

Figure 2:
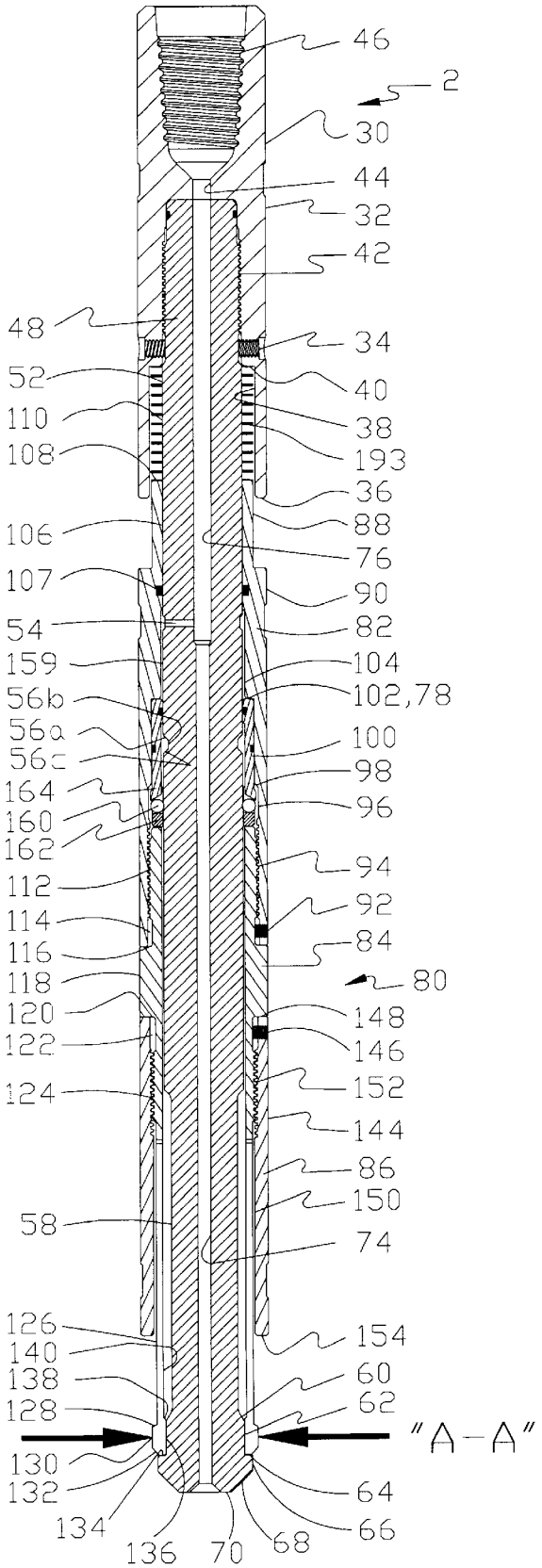
FIGS. 2A & 2B are sectional views of the preferred embodiment of the present invention shown in a first position.
Figure 2A:
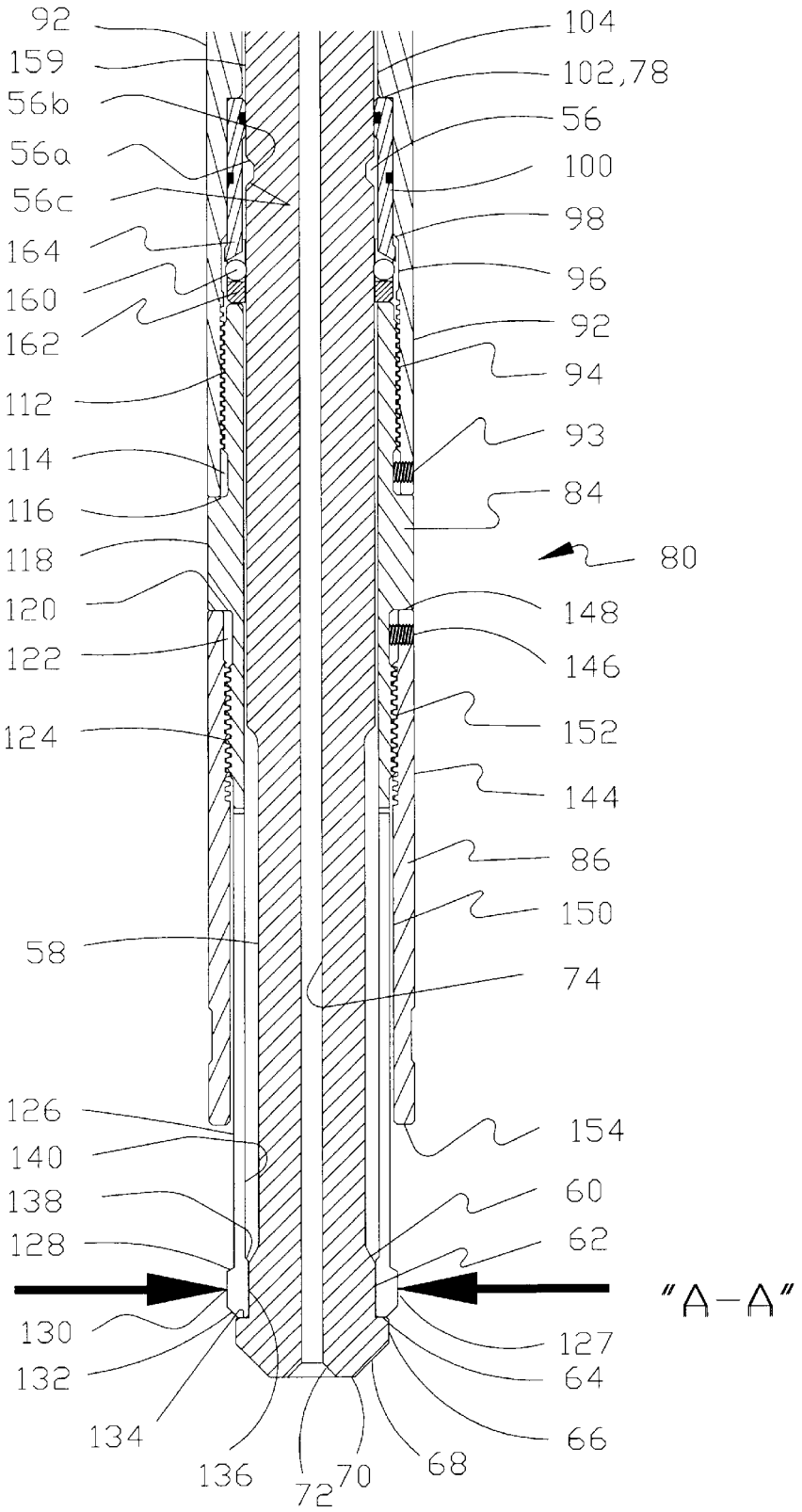
Figure 2B:
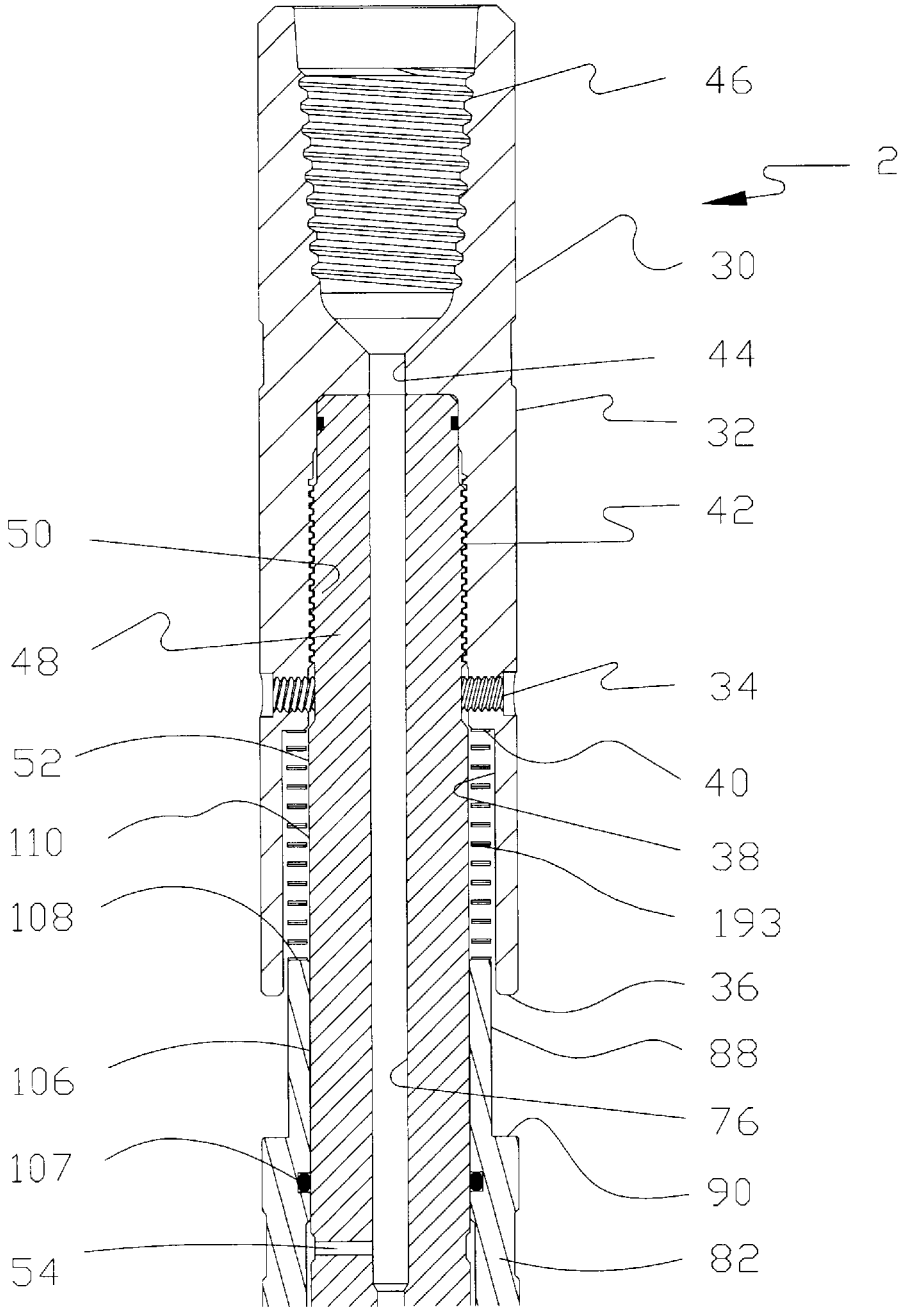

Referring now to FIGS. 2A & 2B, the preferred embodiment of the present invention will now be explained. As seen in FIG. 2B, the spear apparatus 2 generally comprises an upper mandrel housing member 30 that contains an outer cylindrical surface 32 that contains an opening 34 for placement of a set screw (not shown). The surface 32 terminates at the radial surface 36 which in turn extends to the inner cylindrical surface 38 and shoulder 40. The shoulder will extend to the internal thread means 42 which in turn stretches to the bore 44 and the internal thread means 46.

The mandrel 48 contains the external thread means 50 that cooperate with the internal thread means 42. The mandrel 48 extends to the cylindrical surface 52. The cylindrical surface 52 has contained therein an activating means 54 for activating the locking means which will be described in greater detail later in the application. The activating means 54 in the preferred embodiment is an aperture 54 communicating the outer diameter of the mandrel 48 with the inner diameter of the mandrel 48. As seen in FIG. 2A, the surface 52 will also contain the groove 56 that contains the surfaces 56*a*, 56*b*, and 56*c*.

The surface 52 continues to the reduced diameter surface 58 which in turn extends to the chamfered surface 60 and in turn extends the cylindrical surface 62, with the surfaces 60, 62 being also referred to as cam surfaces. The cylindrical surface 62 terminates at the radial shoulder 64 that extends to the cylindrical surface 66, with the surface 66 continuing to the chamfered surface 68. The chamfered surface 68 will in turn lead to the end 70, with the end 70 leading to the angled surface 72 that in turn leads to the first inner bore 74 and second inner bore (of increased diameter) 76 which is in communication with the bore 44. As seen in FIG. 2B, the activating means aperture 54 is in communication with the bore 76.

The collet member 80 will now be described. The collet member 80 generally comprises an upper housing 82, collet housing 84, and lower housing 86. The upper housing 82 has a first outer cylindrical surface 88 that extends to the radial shoulder 90 that terminates at the second outer cylindrical surface 92, with the surface 92 having contained therein an opening 93 for placement of an allen screw (not shown). Extending radially inward will be the internal thread means 94 that in turn extends to the first inner bore surface 96. The first inner bore surface 96 leads to the chamfered surface 98 that in turn extends to the second inner bore surface 100, with the second inner bore surface 100 concluding at the radial shoulder 102. The radial shoulder 102 concludes at the third inner bore 104 which in turn stretches to the fourth inner bore (of reduced inner diameter) 106, with the fourth inner diameter bore 106 containing thereon a groove for placement of a seal member (o-ring 107). The fourth inner bore 106 terminates at the shoulder 108.

As seen in FIG. 2B, a spring cell 193 is formed between the shoulder 108, mandrel 48, and the inner cylindrical surface 38 for placement of a biasing means 110 for biasing the collet member 80. The biasing means 110 may be a conical spring, belleville washer springs, or even a charged inert gas.

Figure 4:
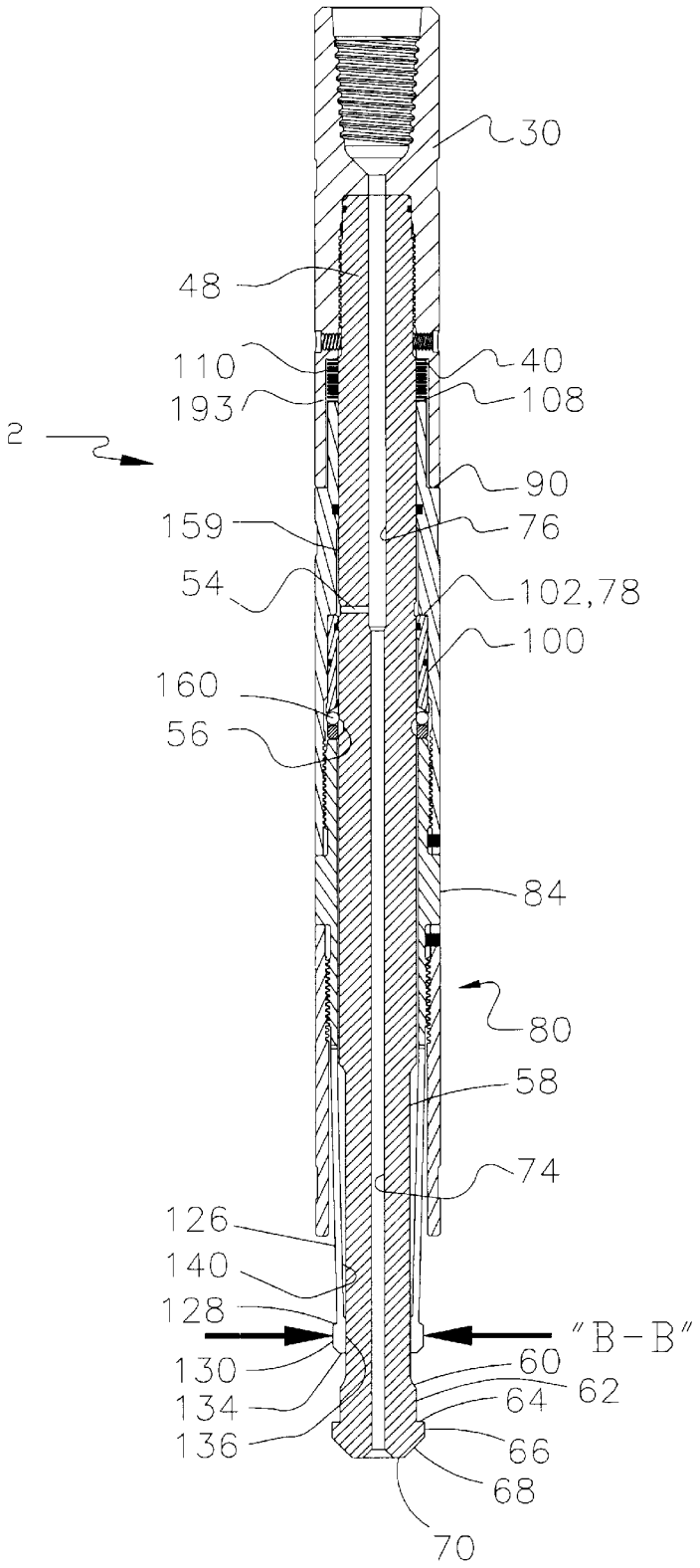
FIG. 4 is a sectional view of the embodiment of FIGS. 2A & 2B when the apparatus is in a second position.

Referring now to FIG. 2A, the collet housing 84 will now be described. The collet housing 84 has external thread means 112 that cooperate with the internal thread means 94, with external thread means 112 extending to surface 114 and on to the shoulder 116. The shoulder 116 terminates at the outer cylindrical surface 118 which in turn extends to the shoulder 120. The shoulder 120 terminates at the surface 122 which continues to the external thread means 124 which in turn extends to the collet tines 126 outer cylindrical surface 127 (not shown in FIG. 2A). The collet tines 126 may be a solid piece, or may be formed as several individual segments. In the preferred embodiment, the tines 126 will be individual segments that extend from the continuous collet housing 84. By having individual segments, the collet tines 126 have more elasticity for engagement with the down hole object, as will be more fully explained. In the preferred embodiment, the individual tines 126 will be bowed, or contracted, as seen in FIG. 4.

The individual collet tines 126 outer cylindrical surface will extend to the chamfered surface 128 which in turn terminates at the outer surface 130, with the outer surface 130 concluding at the angled surface 132. The angled surface 132 stretches to the radial end 134, with the radial end 134 cooperating with the radial shoulder 64 of the mandrel 48. Extending radially inward will be the inner surface 136 that cooperates with the cylindrical surface 62 of the mandrel 48, with the inner surface 136 extending to the angled surface 138 which in turn extends to the inner surface 140.

The lower housing 86 is seen in FIG. 2A. Generally, the lower housing 86 comprises an outer cylindrical surface 144 that has disposed therein an opening 146 for placement of an allen screw (not shown), with the surface 144 terminating at the radial end 148. Extending radially inward will be the inner bore surface 150 that will have contained thereon the internal thread means 152 that cooperate with the external threads 124. The inner bore surface 150 concludes at the radial end 154.

With reference to FIG. 2A, the locking means for locking the collet member 80 with the mandrel 48 will now be described. The locking means consist of a detent member 160, a detent housing 162, and a piston means 164 for activating detent member 160 and detent housing 162 into a locked position. A chamber area 159 is formed by upper housing 82, collet housing 84, seal member 107 and the mandrel 48. The detent housing 162, detent member 160, and piston means 164 are located within the chamber 159.

Figure 3:
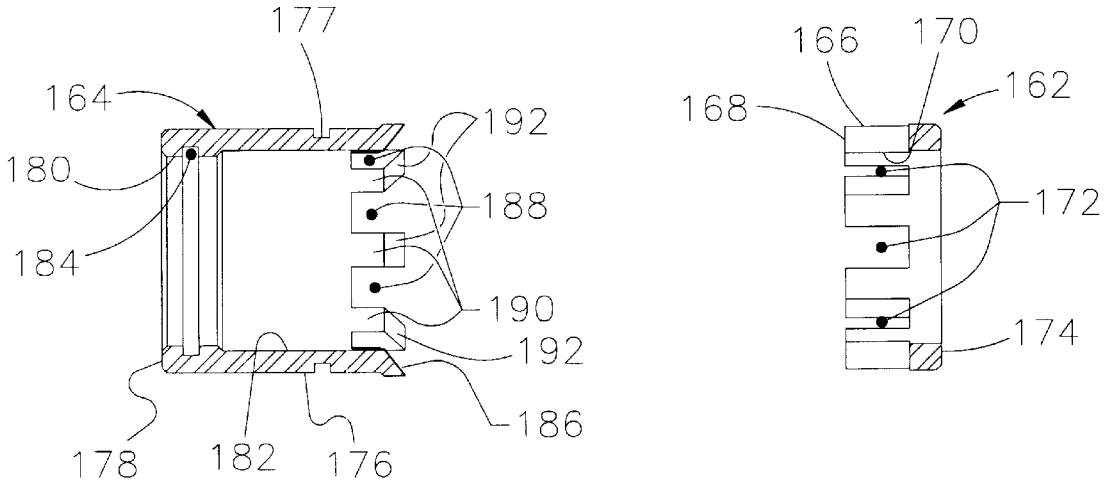
FIG. 3 is an enlarged sectional view of the preferred embodiment of the locking member of the present invention.

FIG. 3 depicts an enlarged sectional view of the preferred embodiment of the detent housing 162 and piston means 164. Generally, the detent housing 162 comprises an outer cylindrical surface 166 that concludes at radial end 168 which in turn extends radially inward to the inner bore surface 170. As depicted, multiple slots 172 have been milled into the housing 162 so that arms are formed on the housing 162 for cooperation with the piston means 164 as will be more fully explained. The inner bore surface 170 terminates at the radial end 174.

The piston means 164 comprises an outer cylindrical surface 176 having a groove 177 for placement of a sealing device (not shown), with the surface 176 that concludes at the radial end 178. Extending radially inward will be the first inner bore surface 180 and second inner bore surface 182, with the first inner bore 180 containing a groove 184 for placement of an o-ring. The second inner bore surface 182 concludes at the end 186. As depicted in FIG. 3, the piston means 164 has a plurality of slots 188 milled therein generating multiple prongs 190 for cooperation with the slots 172 of the detent housing. The individual prongs 190 will have angled faces 192. The detent means 160 (shown in FIG. 2B but not shown in FIG. 3) for cooperating with the groove 56 will be placed in between the piston means 164 and the detent housing 162. While the detent member 160 shown is a spherical device, other shapes may be used such as oval, lug shaped, etc.

In operation of the preferred embodiment shown in FIGS. 2A & 2B, the apparatus 2 will be positioned within the well bore 16 via attachment to the work string 22. The work string 22 may be a drill string, coiled tubing, snubbing pipe, etc. The work string 22 with attached spear apparatus 2 (connected via the internal thread means 46) will be lowered into the well bore in the run-in position seen in FIGS. 2A–2B, which is also known as latched or engaged. As seen in FIGS. 2A–2B, the spear apparatus 2 has no compressive load. Therefore, the spring member 38 within the chamber 193 acts against the shoulder 108 so that the collet member 80 is extended, and in particular, the collet tines 126 are urged against the radial shoulder 64 of the mandrel 48.

The position seen in FIGS. 2A & 2B may be referred to as the latched, run and/or engaged position. The detent member 160 is secured into the detent housing 162 for cooperation with the piston means 164. Since the detent member 160 is not positioned within relative to each other I.e. the mandrel 48 and collet member 80 are not locked together.

Referring now to FIG. 4, the spear apparatus 2 is shown in the compressed position when a load has been applied to the tool to sufficiently bias the spring within the spring cell 193. This situation arises, for instance, when the operator is lowering the spear 2 on the work string 22 into engagement (latching) with the down hole object 7 to be latched onto. Another situation may be that the operator is ready to unlatch from the down hole object 7. Yet another situation includes when the operator desires to transmit a down jarring action via the work string 22 to the down hole object 7.

Thus, in the position seen in FIG. 4, the work string 22 has been slacked-off so that the weight of the work string 22 is transmitted to the down hole object 7. This in turn causes the mandrel 48 to be lowered relative to the object 7 as well as the collet member 80 so that the spring within the spring cell 193 is compressed. Once the spring is fully compressed, the mandrel 48 and the collet member 80 can no longer be lowered. At the fully compressed position, a down jarring action may be attempted by the operator. The down jarring action may be desirable in order to dislodge the down hole object 7, or alternatively, may be desirable in causing necessary mechanical manipulation to set or un-set down hole devices such as packers.

During the course of operations, the operator may desire to pump a fluid down the inner diameter of the work string 22 and inner diameter 74, 76 of the spear apparatus 2. Thus, pumping of the fluid would begin. In accordance with the teachings of the present invention, the fluid being pumped down the inner diameter of the spear apparatus 2 would also enter the activating means 54, and the hydraulic pressure thus created would act in the chamber 159. In accordance with the teachings of the present invention, the pressure increase within the chamber 159 acts on the piston means 164, and in particular, the radial end 178. In turn, the pressure within the chamber 159 will force the piston means 164 into engagement with the detent housing 162, with the multiple prongs 190 cooperating with multiple slots 172. The detent member 160 is held within the housing by the hydraulic pumping. The angled faces 192 will be pressed against the detent member 160.

Figure 5:
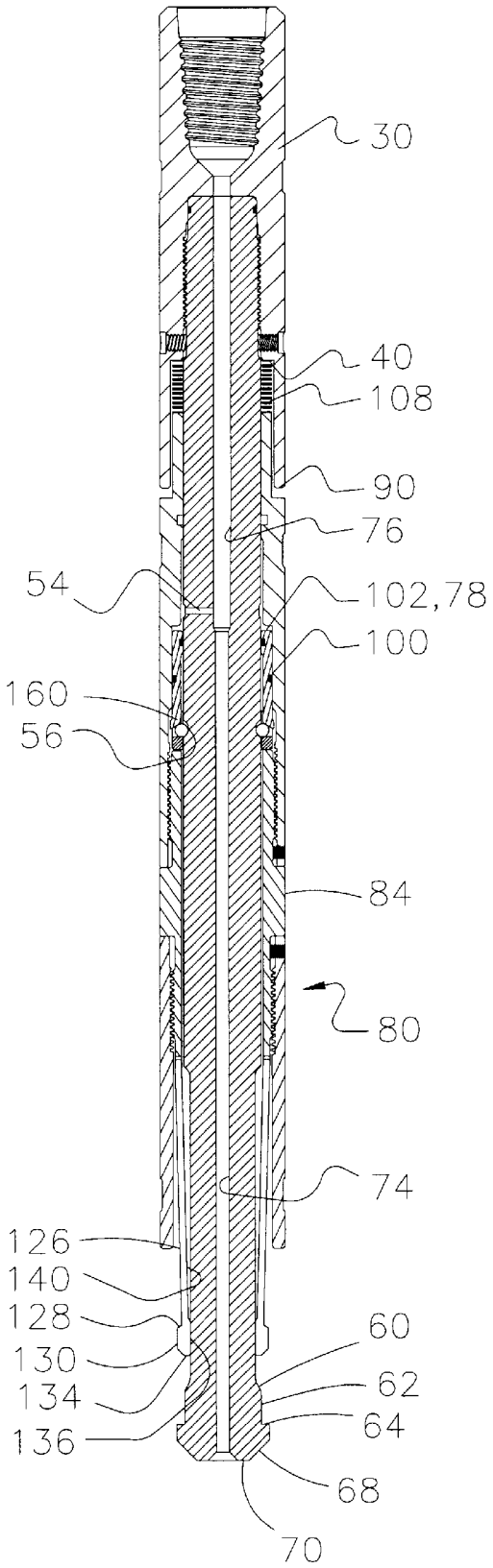
FIG. 5 is a sectional view of the embodiment of FIG. 3 when the apparatus is in the third position.

With reference to FIG. 5, once the operator slacks off weight, i.e. lifts up on the work string, continued pumping will in turn cause the detent member 160 to be urged into the groove 56 since the angled faces 192 of the prongs 190 cooperate with the curved detent member 160 in order to force the detent member 160 into the groove 56. The angled nature of the faces 192 insure that detent member 160 falls into the groove 56 regardless if the well bore is vertical or horizontal. Once the detent member 160 is in the groove 56, continued pumping creates a continuous pressure within the chamber 159 so that the piston means 164 continues to act on the detent housing 162. This continued pumping acts to force the detent member 160 onto the face 56*c* thereby holding the detent member 160 into the groove 56. When the detent member 160 is held into place as described, the mandrel 48 and collet member 80 will be effectively locked together. As seen in FIG. 5, this may be referred to as the released position since the tool 2 is effectively release from the fishing neck, or alternatively, may be referred to as the ※locked※ position since the mandrel 48 and the collet member 80 are locked together. The operator may exert a pulling force on the work string, or may alternatively, exert a downward force on the work string. Regardless, the mandrel 48 and collet member 80 stay locked together as long as pumping is continued. Thus, during the pumping, the operator may pull out of the well since the collet tines surface 130 is free to collapse to surface 58.

In order to release from the locked position, the operator may discontinue pumping. The piston means 164 will no longer be urged downward into engagement with the detent housing 162. Thus, the detent members 160 are allowed to fall out of the groove 56. The operator may then raise the work string 22 which in effect raises the mandrel 48. This has the effect of allowing the biasing means 110 to expand and urge the collet member 80 downward relative to the mandrel 48 into the position seen in FIG. 2. Note the position of the collet tines 126 in relation to the cam surfaces 60, 62 of the mandrel 48 which effectively expands the collet surface 130 into engagement with the fishing neck of the down hole object. This position of the spear apparatus 2 also corresponds to the latched position. If the tool 2 is latched to the object, the operator may begin to pull on the work string 22 which effectively pulls the object in order to dislodge it. If it is desired to pump fluid again, the tool 2 will not return to the locked position of FIG. 5. According to the teachings of the present invention, the tool will not go from the latched position of FIG. 2 and return to the locked position of FIG. 5(where the collet and mandrel are locked together) unless the tool 2 is set on a bottom overcoming the biasing of the spring 110.

Figure 6:
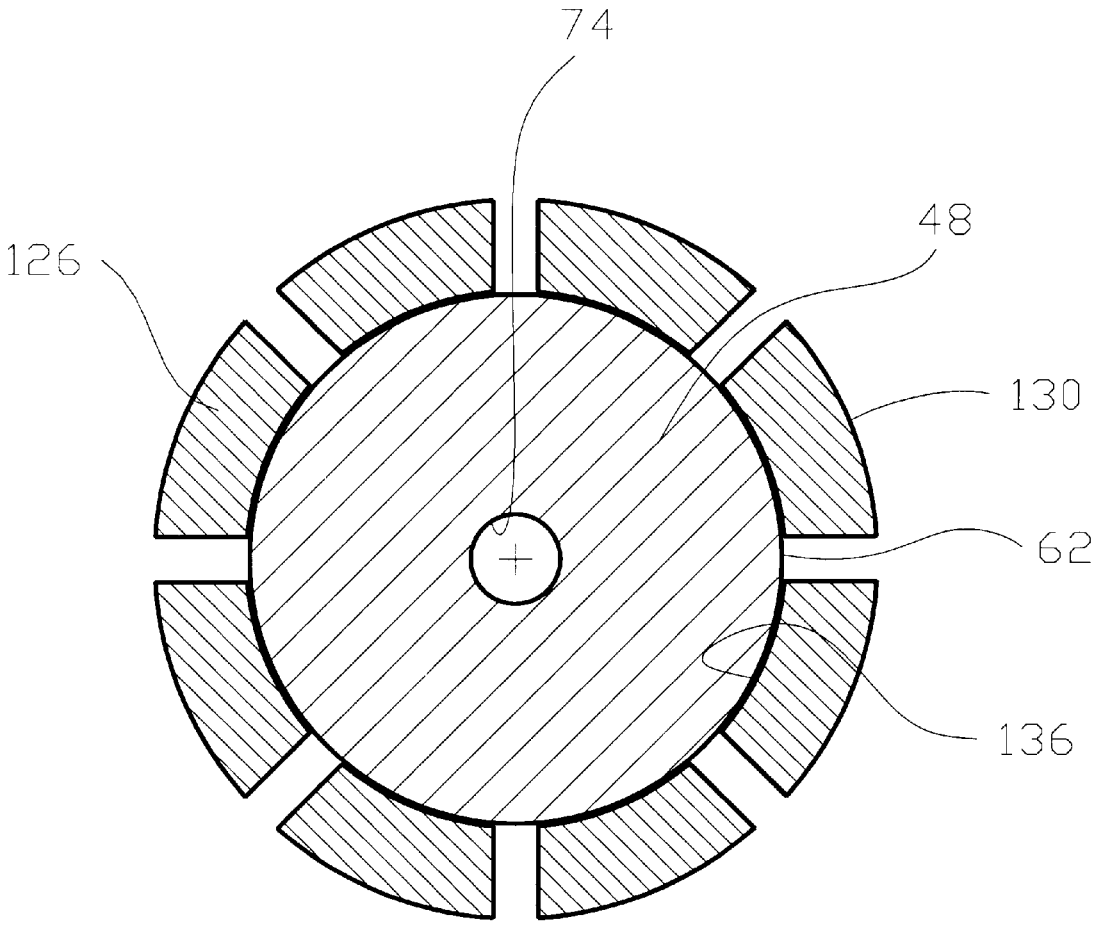
FIG. 6 is a cross-sectional view of the collet tines and mandrel taken along line A—A of FIG. 2A.
Figure 7:
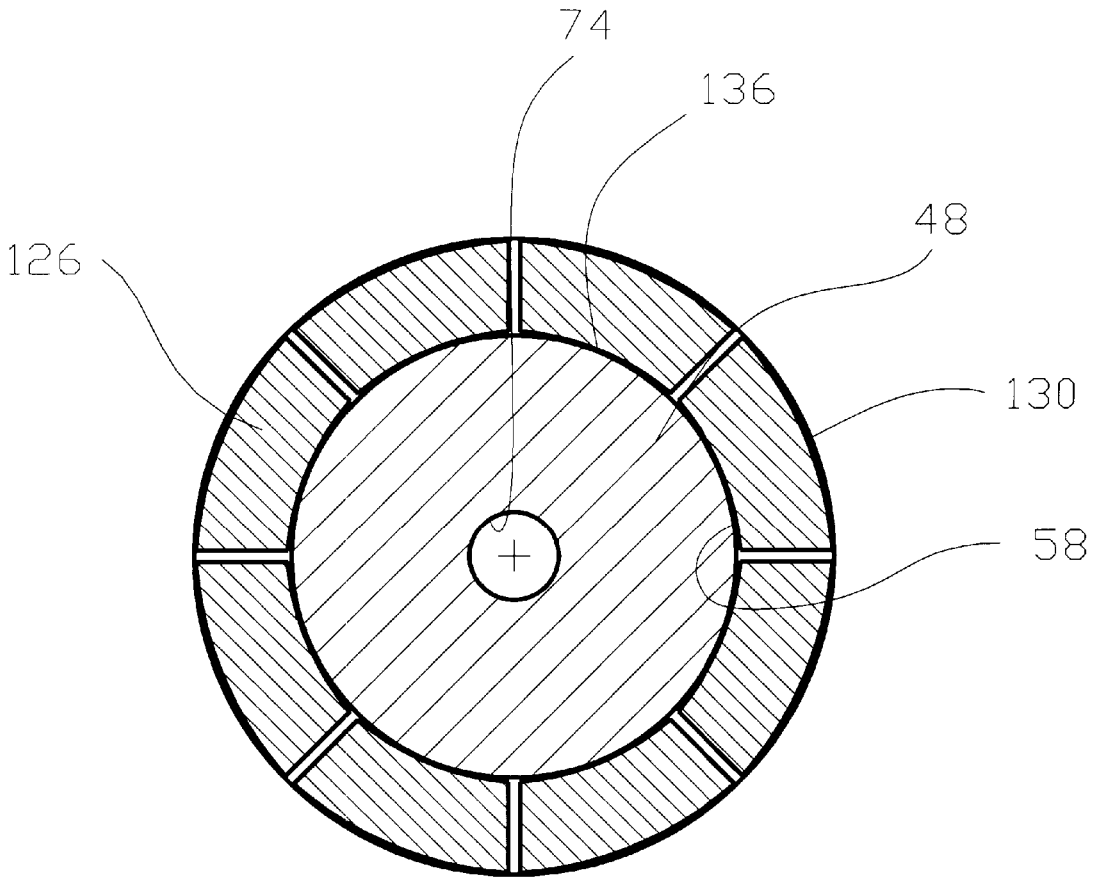
FIG. 7 is a cross-sectional view of the collet tines and mandrel taken along line B—B of FIG. 4.

Referring now to FIG. 6, a cross-sectional view of the collet tines 126 about the mandrel 48 taken along line A—A of FIG. 2B. Thus, the individual collet tines 126 have been separated apart via the cam surfaces 60, 62 of mandrel 48. The outer surface 130 of the collet tines 126 may be used to engage with the down hole object. FIG. 7 represents the a cross-sectional view of the collet tines 126 taken along line B—B of FIG. 4. Thus, the individual collet tines 126 are allowed to collapse to the reduced outer surface 58 of the mandrel 48 thereby allowing the outer surface 130 to clear the down hole object's opening i.e. fishing neck.

Figure 8:
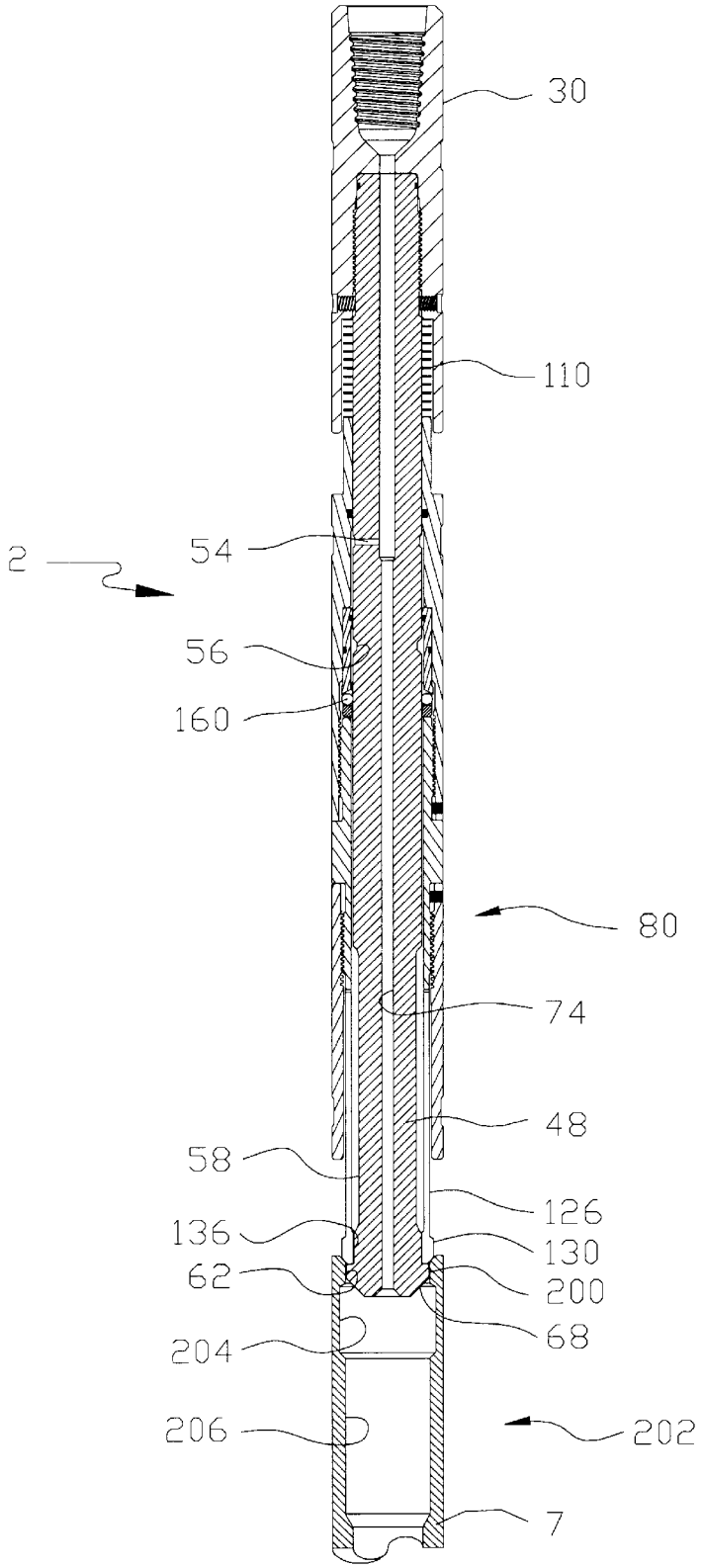
FIG. 8 is an illustration showing the embodiment of FIGS. 2A & 2B entering a fishing neck of a bottom hole object.

A sequence of figures showing the preferred embodiment of FIG. 2 entering, being latched within an object, and thereafter being released will now be described. FIG. 8 is an illustration showing the embodiment of FIGS. 2A & 2B entering a fishing neck of a bottom hole object. Thus, the cylindrical surface 62 of the mandrel 48 is allowed through the opening 200 of the object 202 which will in turn contact the angled surface 132, and in particular, push the tines 126 up relative to the mandrel 48 thereby allowing the tines to contract about the surface 58. The object 202 contains a first diameter inner bore 204 that extends to the second diameter inner bore 206 so that an engagement area is formed, which is commonly referred to as a fishing neck. The spear 2 may be continued to be lowered which allows the mandrel 48 to continue downward relative to the object 200. This continued movement will compress the spring 110. Due to the reduced diameter of the mandrel surface 58, the tines 126 will be allowed to collapse about the mandrel thereby allowing the outer surface 130 to pass the opening 200 of the object 202.

Figure 9:
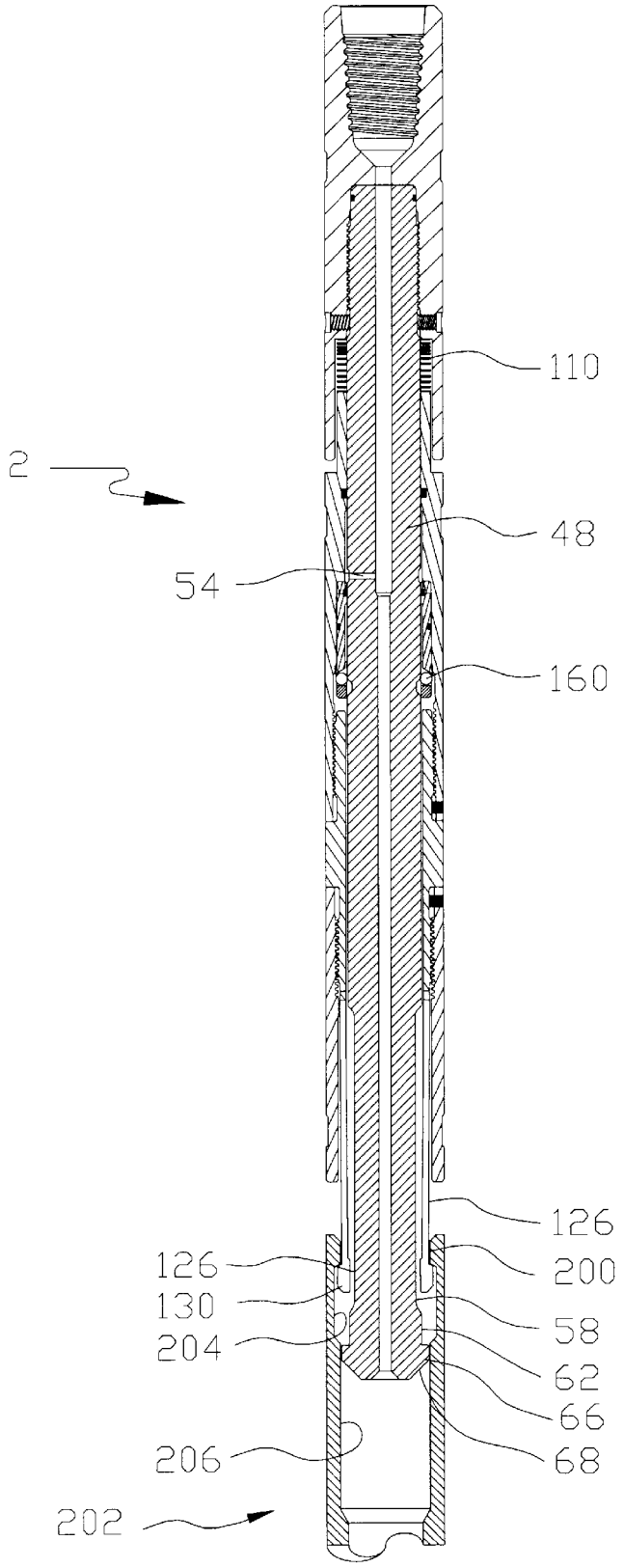
FIG. 9 is the illustration of FIG. 8 shown entered into the fishing neck of the bottom hole object.
Figure 10:
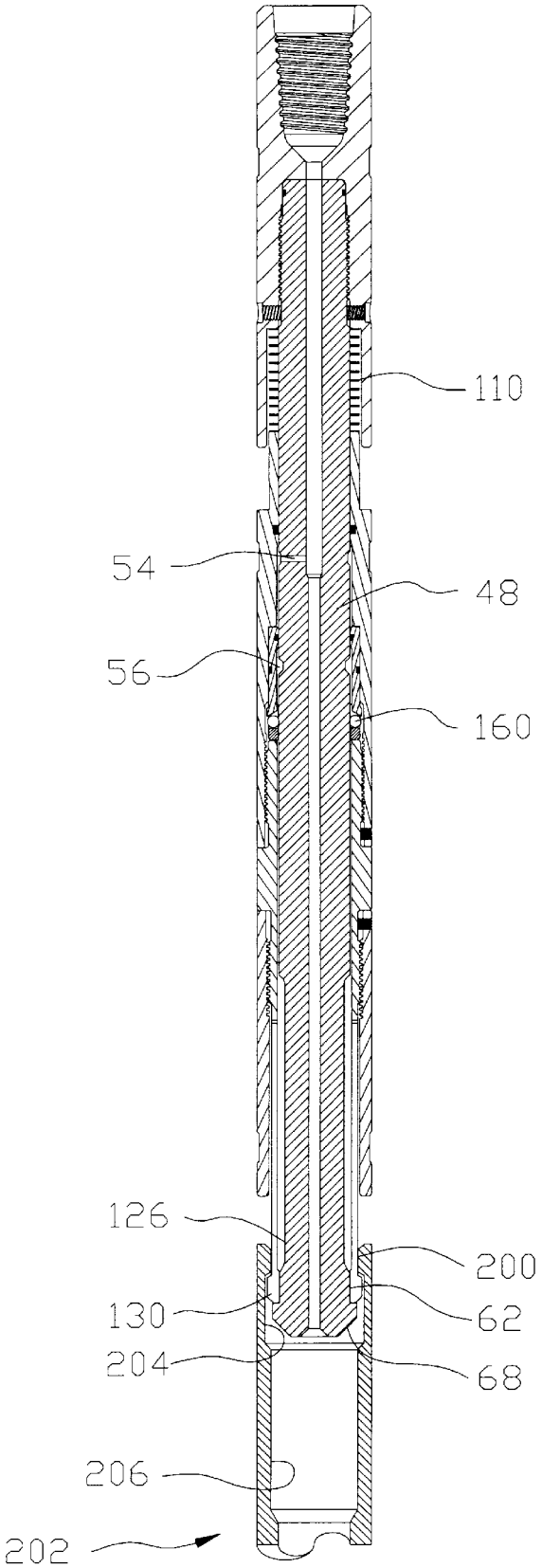
FIG. 10 is the illustration of FIG. 9 engaged into the fishing neck of the bottom hole object.

Referring now to FIG. 9, the spear 2 of FIG. 8 is shown entered into the opening 200 of the bottom hole object 202. Thus, the collet tines 126 were not allowed to proceed downward into the inner bore 206 due to the outer diameter of the tines 130. Next, and as seen in FIG. 10, the tines 126 will expand within the fishing neck with an upward pull on the work string due to their interaction with the cam surface 60, 62. In this position, the outer surface 130 engages with the inner bore 204 and opening 200 so that the spear 2 is latched into the object 202.

Figure 11:
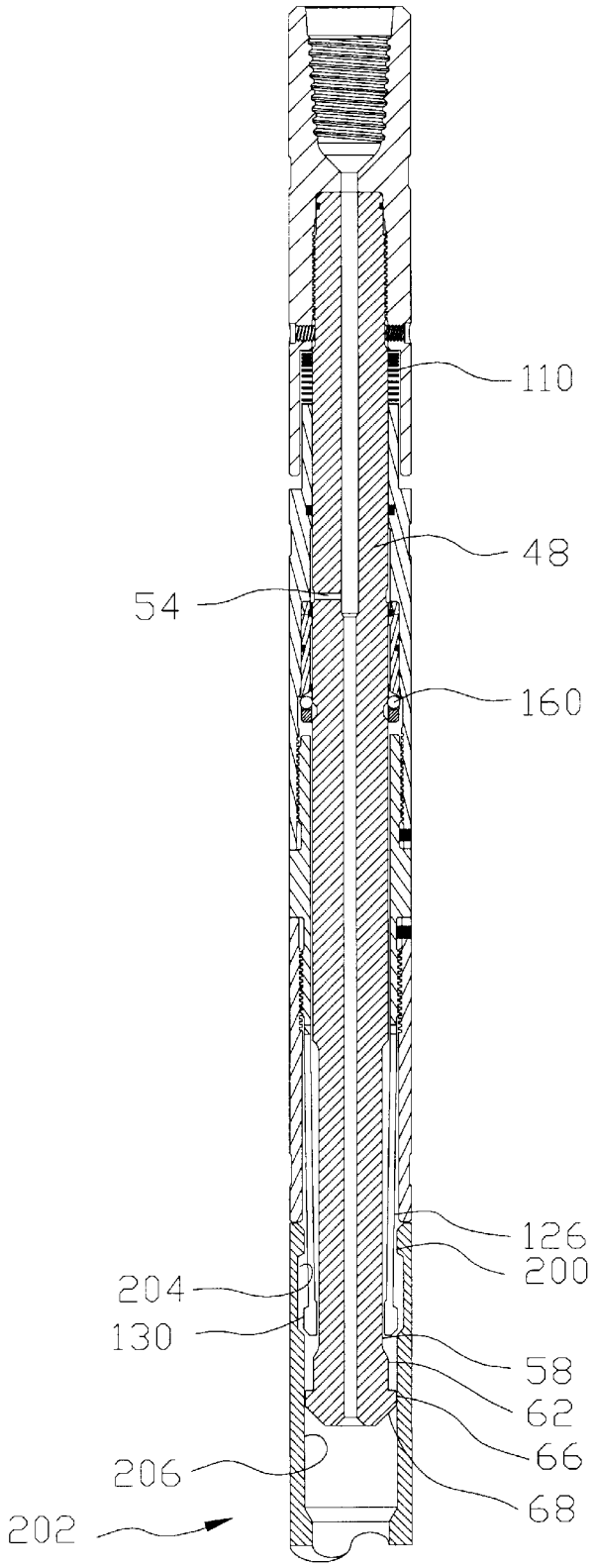
FIG. 11 is the illustration of FIG. 10 depicting the invention being released from the fishing neck of the bottom hole object?

The operator may wish to begin pumping the fluid down the work string 22. If the operator wishes to release from the object, the operator will slack off weight on the work string 22 so that the tines may collapse about the mandrel 126, and then initiate pumping which will in turn lock the detent members 160 into the groove 56 as previously described and as shown in FIG. 5. Once the locking means have been activated, the operator may pull out of the opening 200 since the tines 126 have been allowed to contract as seen in FIG. 11. The operator is given the option of pulling into and out of the object 202 with the design of the present invention.

Figure 12:
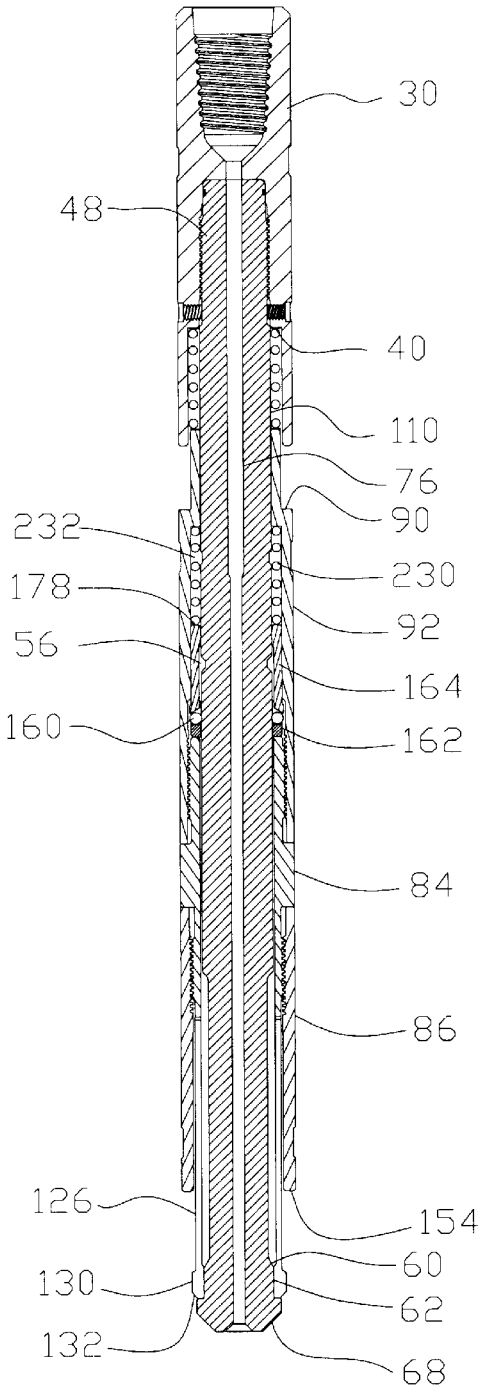
FIG. 12 is a second embodiment of invention herein described.

FIG. 12 depicts another embodiment of the invention herein disclosed. This embodiment will contain a spring means 230 for biasing the piston means 164 into the detent housing 162 and into the groove 56 as previously described. The spring means 230 may be a conical spring and will be located within the spring chamber 232 that is formed between the housing 82 and the mandrel 48. In operation, as the mandrel 48 is lowered into contact with the object, the collet tines 126 will be allowed to slide about the mandrel 48. The continued downward movement of the work string will compress spring means 110 and once the groove 56 is aligned with the detent member 160, the spring means 230 will urge detent member 160 into the groove so that the collet member 80 is locked relative to the mandrel 48.

Once locked, the operation of pumping may progress as previously described with reference to FIG. 9. In order to unlock the collet member 80 from the mandrel 48, the operator will slack-off weight so that the mandrel end 68 and collet tine end 134 are both contacting the object thereby transmitting a force to the spring 110 so that the spring 110 compresses. Once the spring 110 is compressed, shoulder 36 will abutt shoulder 90 which in turn allows the detent member 160 to become unseated within the groove 56. Once unseated, the operator can lift-up on the work string quickly which in turn allows the spring 230 to urge the detent member 160 and the detent housing 162 downward relative to the mandrel 48, as seen in FIG. 12.

Changes and modifications in the specifically described embodiments can be carried out without departing from the scope of the invention which is intended to be limited only by the scope of the appended claims.

I claim:

1. An apparatus for engaging an object within a well bore comprising:

a mandrel connected to a work string, said mandrel having an inner diameter and an outer diameter, said outer diameter having a constant outer diameter circumference;

a collet member slidably disposed on said outer diameter of said mandrel, said collet member forming a chamber disposed about said mandrel;

locking means, contained within said chamber, for locking said collet with said mandrel in order to prevent lateral movement of said collet member relative to said mandrel.

2. The apparatus of claim 1 further comprising:

biasing means, slidably disposed on said mandrel, for biasing said collet member in a first direction.

3. The apparatus of claim 2 further comprising:

activation means, associated with said mandrel, for activating said locking means.

4. The apparatus of claim 3 wherein said collet member includes:

a first and a second end, said first end containing a first engaging member;

and wherein said mandrel has a first end and a second end, and said second end contains a second engaging member.

5. The apparatus of claim 4 wherein said locking means comprises:

a detent member;

a housing member containing said detent member;

a piston means, operatively associated with said housing member, for activating said locking means;

and wherein said mandrel contains a groove that cooperates with said detent member.

6. The apparatus of claim 5 wherein said activation means comprises:

a passage in communication between the inner diameter of said mandrel and said chamber so that a pressure in said inner diameter of said mandrel is communicated with said chamber.

7. The apparatus of claim 6 wherein said piston means comprises:

a hydraulically responsive member disposed about said mandrel, and wherein said hydraulically responsive member is operatively associated with said housing member.

8. The apparatus of claim 7 wherein said work string is attached to a coiled tubing string, and wherein said object is a stuck object within the well bore.

9. The apparatus of claim 5 wherein said piston means comprises:

a mechanically responsive cylindrical member disposed about said mandrel; and, a spring disposed within said chamber adapted to urge said mechanically responsive cylindrical member so that said detent member is adapted within said groove.

10. A device for latching onto a down hole object located within a well bore comprising:

a mandrel having a first end connected to work string and having a second end containing a cam surface thereon;

a biasing member disposed about said mandrel;

a collet member operatively disposed about said mandrel, with said collet member having a first end adapted to cooperate with said biasing member and a second end having engaging means, operatively associated with said cam surface of said mandrel, for engaging the object, said mandrel and said collet member forming a chamber therein;

locking means, contained within said chamber, for locking said mandrel relative to said collet member and wherein said locking means comprises: a detent member, a housing member containing said detent member: a piston member operatively associated with said housing member, and wherein said mandrel contains a groove that cooperates with said detent member.

11. The device of claim 10 wherein said biasing member comprises a spring member adapted to urge said collet member into engagement with said second end of said cam surface.

12. The device of claim 11 further comprising:

activation means, associated with said mandrel, for activating said piston member so that said piston member urges said detent member within said groove.

13. The device of claim 12 wherein said engaging means includes a protuberance for cooperation with a fishing neck contained within said down hole object.

14. The device of claim 13 wherein said activation means comprises:

a passage in fluid communication between the inner diameter of said mandrel and said chamber so that a pressure in said inner diameter is communicated with said chamber.

15. The device of claim 14 wherein said work string is a drill string, and wherein said object is a packer means.

16. A method of engaging an object within a well bore, said object containing a fishing neck, said method comprising:

positioning a spear device into the well bore, said spear device containing:

a mandrel having a first end connected to a work string and having a second end with a cam surface; a biasing member disposed about said mandrel; a collet member operatively disposed about said mandrel, with said collet member having a first end adapted to cooperate with said biasing member and a second end having a protuberance adapted to engage the object, said mandrel and said collet member forming a chamber therein; locking means, contained with said chamber, for locking said mandrel relative to said collet member;

lowering said spear device so that said second end of said mandrel enters said object;

contacting said protuberance of said collet member with the object so that said collet member remains stationary in relation to the object;

lowering said mandrel into said object;

compressing said biasing member;

contracting said collet member about the mandrel;

lowering said collet member through said fishing neck;

pulling said work string so that said biasing means urges said protuberance into cooperation with said cam surface;

engaging said object by expanding said protuberance into cooperation with said fishing neck.

17. The method of claim 16 further comprising:

lowering said work string;

setting said mandrel and said protuberance on said fishing neck so that said biasing means becomes depressed;

allowing said mandrel to move downward relative to said collet member so that said protuberance no longer cooperates with said cam surface;

pumping a fluid through the inner diameter of said work string and said mandrel;

activating said locking means into engagement.

18. The method of claim 17 wherein said locking means includes: a detent member; a housing member containing said detent member; a piston means, operatively associated with said contained within said chamber, for activating said locking means; and wherein said mandrel contains a groove that cooperates with said detent member; and wherein the method of activating said locking means includes:

engaging said piston means with said housing;

applying a pressure in said chamber by said pumping of the fluid;

moving said housing downward relative to said mandrel;

positioning said detent member into said groove so that said mandrel is locked with said collet member.

19. The method of claim 18 further comprising:

terminating the pumping of fluid so that the pressure in said chamber is no longer applied;

allowing said detent members to fall out of said groove so that said mandrel is no longer locked with said collet member;

lowering said work string so that said protuberance is urged into cam surface by lowering said;

raising said work string;

engaging said spear device within said fishing neck.

20. The method of claim 18 further comprising:

pulling on said work string;

raising said protuberance from said fishing neck;

raising said second end of said mandrel from said fishing neck;

disengaging said spear device from said object;

pulling said work string from the well bore.

* * * * *